US005865426A

United States Patent [19]

Kazerooni

[11] Patent Number: 5,865,426

[45] Date of Patent: Feb. 2, 1999

[54] HUMAN POWER AMPLIFIER FOR VERTICAL MANEUVERS

[76] Inventor: Homayoon Kazerooni, 2806 Ashby Ave., Berkely, Calif. 94705

[21] Appl. No.: 624,038

[22] Filed: Mar. 27, 1996

[51] Int. Cl.[6] ..... B66D 1/00

[52] U.S. Cl. ..... 254/270; 254/266; 212/285; 415/5

[58] Field of Search ..... 254/266, 270; 212/330, 331, 338, 285; 414/2, 4, 5

[56] References Cited

U.S. PATENT DOCUMENTS

| | | | |
|---|---|---|---|
| 2,940,608 | 6/1960 | Underwood et al. | 212/330 |
| 3,921,959 | 11/1975 | Ulbing | 254/270 |
| 3,940,110 | 2/1976 | Motoda | 254/270 |
| 4,557,659 | 12/1985 | Scaglia | 254/270 |
| 5,489,032 | 2/1996 | Mayhall, Jr. et al. | 212/285 |

*Primary Examiner*—Katherine Matecki

*Attorney, Agent, or Firm*—Skjerven, Morrill, MacPherson, Franklin & Friel LLP; David E. Steuber

[57] ABSTRACT

A human power amplifier includes an end-effector which is grasped by a human operator and applied to a load. The end-effector is suspended, via a rope, from a take-up pulley, winch or drum which is driven by an actuator to lift or lower the load. The end-effector includes a force sensor which measures the vertical force imposed on the end-effector by the operator and delivers a signal to a controller. The controller and actuator are structured in such a way that a predetermined percentage of the force necessary to lift or lower the load is applied by the actuator, with the remaining force being supplied by the operator. The load thus feels lighter to the operator, but the operator does not lose the sense of lifting against both the gravitation and inertial forces originating in the load. The operator has direct contact with the load (through the end-effector) there need be no switches, valves, keyboards, teach pendents, or pushbuttons in the human power amplifier to control the lifting speed of the load.

56 Claims, 10 Drawing Sheets

HUMAN POWER AMPLIFIER FOR VERTICAL MANEUVERS

FIELD OF THE INVENTION

The present invention relates to material handling devices and, more specifically, to a material handling device that amplifies the force a human exerts when the human lifts or lowers an object in the vertical direction.

BACKGROUND OF THE INVENTION

Several types of material handling devices are known. One type of material handling device, known as a balancer, consists of a motorized take-up pulley, a rope which wraps around the pulley when the pulley turns, and an end-effector which is attached to the end of the rope. The end-effector has components that connect to the load being lifted. The rotation of the pulley winds or unwinds the rope and causes the end-effector to lift or lower the load. In this class of material handling system, an upward force in the rope exactly equal to the gravity force of the object being lifted is generated by an actuator; the rope tension is equal to the weight of the object. Therefore, the only force the operator must impose to maneuver the object is the force necessary to overcome the object's inertia. This force can be substantial if the mass of the object is large. Therefore, the ability to accelerate or decelerate a heavy object is limited by the operator's strength.

There are two ways of creating a force in the rope so that it is exactly equal to the object weight. First, if the system is pneumatically powered, the air pressure is adjusted so that the lift force equals the weight of the load. Second, if the system is electrically powered, the correct voltage or current (depending on the control circuitry) is provided to an amplifier to generate a lift force that equals the load weight. These types of systems are not suited to maneuvers in which objects of varied weights are lifted. This is true because each object requires a different bias force to cancel its weight force. This annoying adjustment can be done either manually by the operator or electronically by measuring the object weight.

For example, the BA Series of balancers made by Zimmerman International Corporation work based on the above principle. The air pressure is set and controlled by a valve to maintain a constant load balance. The operator has to manually reach the actuator and set the system to a particular pressure to generate a constant tensile force on the rope.

The LIFTRONIC System machines made by Scaglia of Italy also belong to the family of balancers, but they are electrically powered. As soon as the system grips the load, the LIFTRONIC machine creates an upward force in the rope which is equal and opposite to the weight of the object being held. These machines may be considered superior to the Zimmerman BA Series balancers because they have an electronic circuit that balances the load during the initial few moments when the load is grabbed by the system. As a result, the operator does not have to reach the actuator on top and adjust the initial force in the rope. In this system, the load weight is measured first by a force sensor in the system. While this measurement is being performed, the operator should not touch the load, but instead should allow the system to find the object's weight. If the operator does touch the object, the force reading will not be correct. The LIFTRONIC machine then creates an upward force in the rope which is equal and opposite to the weight of the object being held.

Balancers of the kind described above do not give the operator a sense of the force required to lift the load. Also, only the weight of the object is canceled by the rope's tension. Moreover, such balancers are generally not versatile enough to be used in situations in which load weights vary.

Another class of machines is similar in architecture to the machines described above, but the operator uses an intermediary device such as a valve, pushbutton, keyboard, switch, or teach pendent to adjust the lifting and lowering speed of the object being maneuvered. For example, the more the operator opens the valve, the greater the speed generated to lift the object. With an intermediary device, the operator is not in physical contact with the load being lifted, but is busy operating a valve or switch. The operator does not have any sense of how much he/she is lifting because his hand is not in contact with the object. Although suitable for lifting objects of various weights, this type of system is not comfortable for the operator because the operator must focus on an intermediary device (i.e valve, pushbutton, keyboard, or switch). Thus, the operator pays more attention to operating the intermediary device than to the speed of the object. This makes the lifting operation rather unnatural.

SUMMARY OF THE INVENTION

All of the foregoing deficiencies are overcome in a human power amplifier according to this invention.

The human power amplifier includes an end-effector to be held by a human operator; an actuator such as an electric or air-powered or hydraulic motor; a computer or other type of controller for controlling the actuator; and a rope, cable, wire or other type of line for transmitting a tensile lifting force between the actuator and the end-effector. The end-effector provides an interface between the human operator and an object which is to be lifted. A force transfer mechanism such as a pulley, drum or winch is used to apply the force generated by the actuator to the rope or other line which transmits the lifting force to the end-effector. (Note that the word "lifting" herein refers to both lifting and lowering motions.)

The end-effector includes a human interface subsystem and a load interface subsystem. The load interface subsystem in configured so as to grip or otherwise attach to the load and may include, for example, a suction cup, a magnet, or a mechanical member shaped to conform to a surface of the load. The human interface subsystem includes a force sensor which is mounted so as to measure the vertical force imposed on the end-effector by the human operator. A wide variety of force sensors may be used, including strain gauges, load cells, and piezoelectric devices. The vertical force on the end-effector may also be detected by measuring the displacement of a resilient element such as a spring.

A signal representing the vertical force imposed on the end-effector by the human operator, as measured by the force sensor, is transmitted to the controller which is associated with the actuator. The controller causes the actuator to rotate the pulley and move the end-effector appropriately so always only a pre-programmed small proportion of the load force is lifted by the human operator, and the remaining force is provided by the actuator. Therefore, the actuator adds effort to the lifting task only in response to the operator's hand force. With this load sharing concept the operator has the sense that he or she is lifting the load, but with far less force than would ordinarily be required. The force applied by the actuator takes into account both the gravitational and inertial forces that are necessary to move the load. Since the force applied by the actuator is automatically determined by the force applied to the end-effector by the operator, there is no need to set or adjust the human power amplifier for loads having different weights.

There is no switch, valve, keyboard, teach pendent, or pushbutton in the human power amplifier to control the lifting speed of the load. Rather, the contact force between the human hand and the end-effector is used to control the lifting speed of the load. The human hand force is measured, and these measurements are used by the controller to calculate the required angular speed of the pulley to either raise or lower the rope so as to create sufficient mechanical strength to assist the operator in the lifting task. In this way, the device follows the human arm motions in a "natural" way. When the human uses this device to manipulate a load, a well-defined small portion of the total force (gravity plus acceleration) is lifted by the human. This force gives the operator a sense of how much weight he/she is lifting. Conversely, when the operator does not apply any vertical force (upward or downward) to the end-effector, the actuator does not rotate the pulley at all, and the load hangs motionless from the pulley.

In one embodiment, a single end-effector is used by the operator, who grips the end-effector with one hand. In another embodiment, a pair of end-effectors is connected to the actuator, preferably by means of a pulley arrangement, and the operator grips one of the end-effectors in each hand.

DETAILED DESCRIPTION OF THE INVENTION

Figure 1:
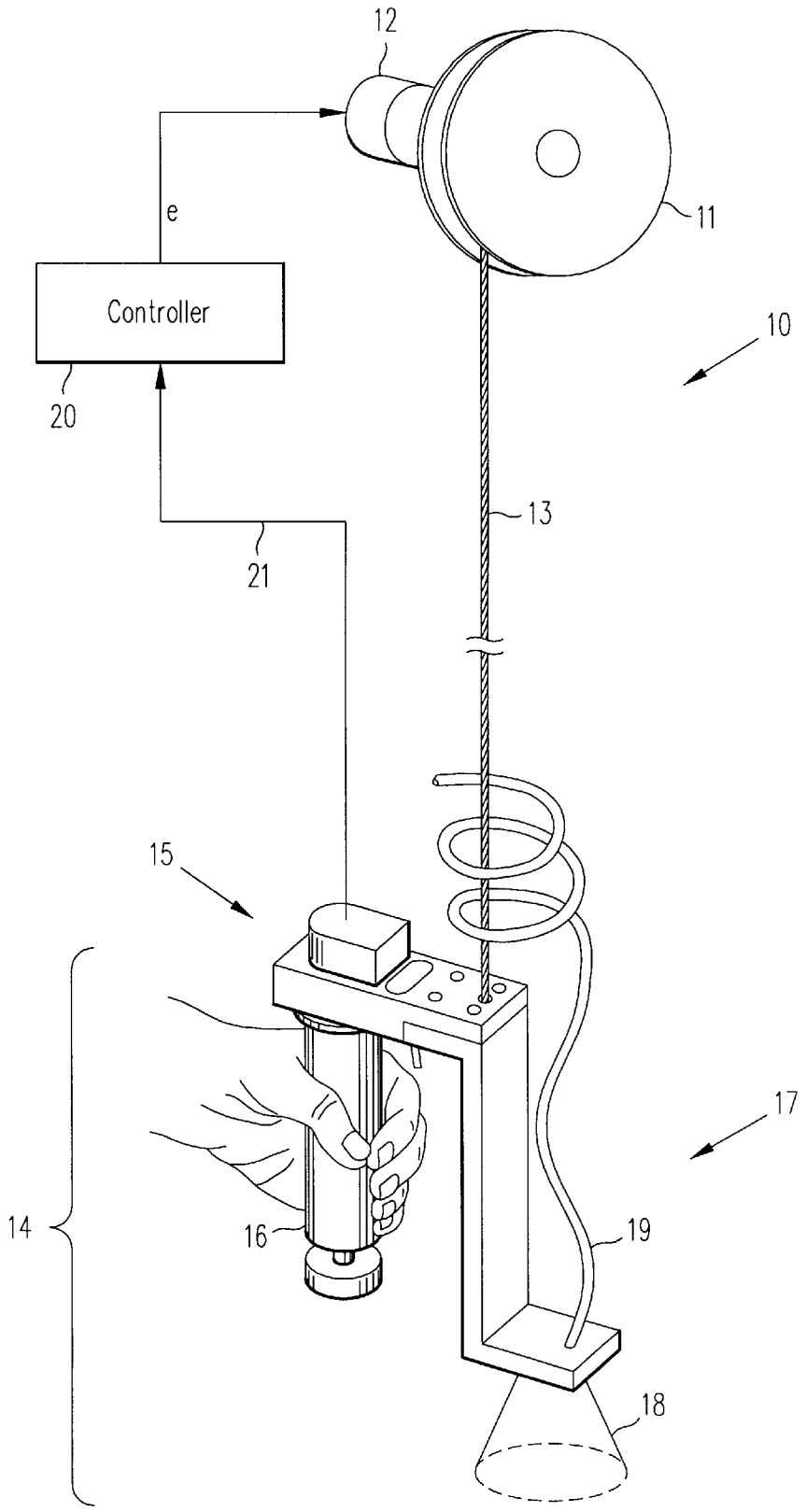
FIG. 1 illustrates an embodiment of the human power amplifier which includes a single end-effector.

FIG. 1 illustrates a first embodiment of the invention, showing a human power amplifier 10. At the top of the device, a take-up pulley 11, driven by an actuator 12, is attached directly to a ceiling, wall, or overhead crane (not shown). Encircling pulley 11 is a rope 13. Rope 13 is capable of lifting or lowering a heavy load when the pulley 11 turns. Attached to rope 13 is an end-effector 14, which includes a human interface subsystem 15 (including a handle 16) and a load interface subsystem 17, which in this embodiment includes a suction cup 18. Also shown is an air hose 19 for supplying suction cup 18 with low-pressure air. Actuator 12 is driven by an electronic controller 20, which receives signals from end-effector 14 over a signal cable 21.

In the preferred embodiment actuator 12 is an electric motor with a transmission, but alternatively it can be an electrically-powered motor without a transmission, an air powered rotary actuator with or without transmission, an air-powered linear actuator with a mechanical transmission to convert the linear motion to rotary motion, a hydraulic rotary actuator, or a hydraulic linear actuator with a mechanical transmission to convert the linear motion to rotary motion. As used herein, transmissions are mechanical devices such as gears, pulleys and ropes which increase or decrease the tensile force in the rope. Pulley 11 can be replaced by a drum or a winch or any mechanism that is able to convert the motion provided by actuator 12 to a vertical motion which lifts and lowers rope 13. Although in this embodiment actuator 12 directly powers the take-up pulley 11, one can mount actuator 12 at another location and transfer power to take-up pulley 11 via another transmission system such as an assembly of chains and spockets. Controller 20 can be an analog circuit, a digital circuit, or a computer with input output capability.

Human interface subsystem 15 is designed to be gripped by a human hand and measures the human force, i.e., the force applied by the human operator against human interface subsystem 15. Load interface subsystem 17 is designed to interface with the load contains various holding devices. The load force is defined as the force imposed by the load on load interface subsystem 17. The design of the load interface subsystem depends on the geometry of the object being lifted and other factors related to the lifting operation. In addition to the suction cup 18 shown in FIG. 1, hooks and grippers are examples of other means that connect to load interface subsystems. For lifting heavy objects, the load interface subsystem may contain several suction cups.

The human interface subsystem 15 of end-effector 14 contains a sensor (described below) which measures the magnitude of the vertical force exerted by the human operator. If the operator's hand pushes upward on the handle 16, the take-up pulley 11 moves the end-effector 14 upward. If the operator's hand pushes downward on the handle 16, the take-up pulley moves the end-effector 14 downward. The measurements of the forces from the operator's hand are transmitted to the controller 20 over signal cable 21. Using these measurements, the controller 20 calculates the amount of pulley rotation necessary to either raise or lower the rope 13 the correct distance to create enough mechanical strength to assist the operator in the lifting task as required. Controller 20 then commands actuator 12 to cause pulley 11 to rotate. All of this happens so quickly that the operator's lifting efforts and the device's lifting efforts are for all purposes synchronized perfectly. The operator's physical movements are thus translated into a physical assist from the machine, and the machine's strength is directly and simultaneously controlled by the human operator. In summary, the load moves vertically because of the vertical movements of both the operator and the pulley.

In this mode of operation, for more stability, one might use an end-effector with two handles. In this case, only one handle needs to be instrumented. For lifting heavy objects, one can use two human power amplifiers similar to the human power amplifier 10 shown in FIG. 1, one for the left and one for the right hand.

Figure 2:
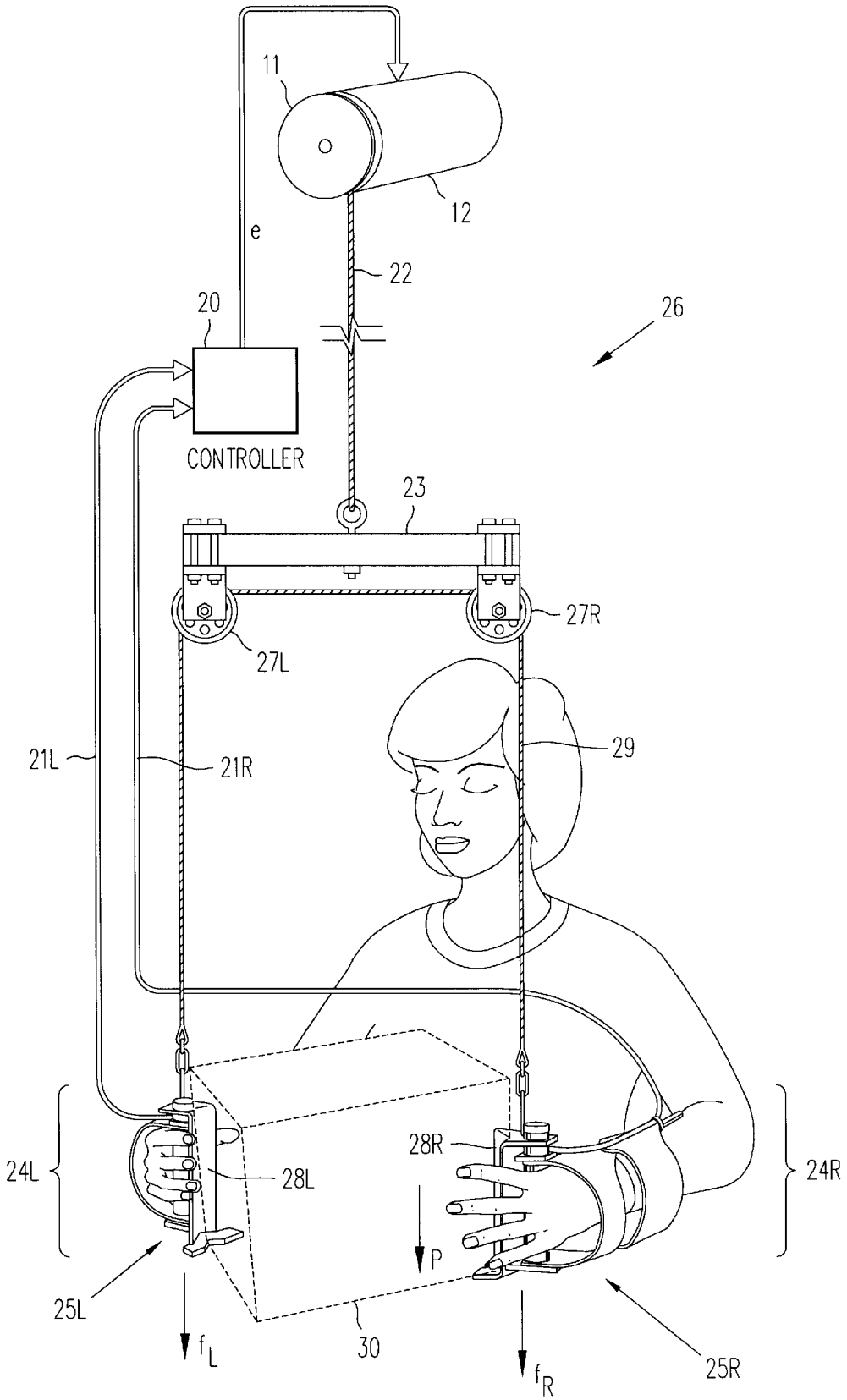
FIG. 2 illustrates an embodiment of the human power amplifier which includes a pair of end-effectors.

A second embodiment of the invention is shown in FIG. 2. In this embodiment, the operator must use both his/her hands to lift the object. In this embodiment, the operator can orient the object being lifted without introducing any other motion to the object.

In the human power amplifier 26 shown in FIG. 2, hanging from pulley 11 is a rope 22. This rope is connected to the horizontal midpoint of a bar 23. Hanging from each end of bar 23 is a single pulley: a left pulley 27L at one end and a right pulley 27R at the other end. Pulleys 27L and 27R are not motorized, but are free to rotate in response to forces on the single continuous rope 29 that runs over pulleys 27L and 27R. Because pulleys 27L and 27R can rotate freely, rope 29 moves freely whenever a force is applied at either end of rope 29; if the end beneath pulley 27L is pulled downward, the end beneath pulley 27R moves upward, and vice versa. End-effectors 24L and 24R, connected to the ends of rope 29, are similar to end-effector 14 shown in FIG. 1, except that suction cup 18 has been omitted and angle pieces 28L and 28R are suited to lifting a box 30.

End-effectors 24L and 24R include human interface subsystems 25L and 25R, respectively. The magnitudes of the vertical forces from the operator's hand movements are measured by sensors (described below) within human interface subsystems 25L and 25R and transmit signals to controller 20 over signal cables 21L and 21R. The sensors within end-effectors 24L and 24R electronically detect the vertical forces from the operator's hands, such as an upward movement of the hands to lift box 30. If both of the operator's hands push upward on the handles, the pulley 11 moves the load-supporting system upward. If both of the operator's hands push downward on the handles, the take-up pulley moves the load-supporting system downward. If the operator pushes upward on one end-effector and downward on the other end-effector, the net force measured by the force sensors is zero, so the pulley 11 does not rotate, and thus the entire device does not move. However the operator can now rotate the object. In this embodiment, only one end-effector (either left or right) can be instrumented. For a given controller, the force amplification (described below) when only one end-effector is instrumented, is smaller than the force amplification when both end-effectors are instrumented.

Several embodiments of the end-effector will now be described.

Figure 3:
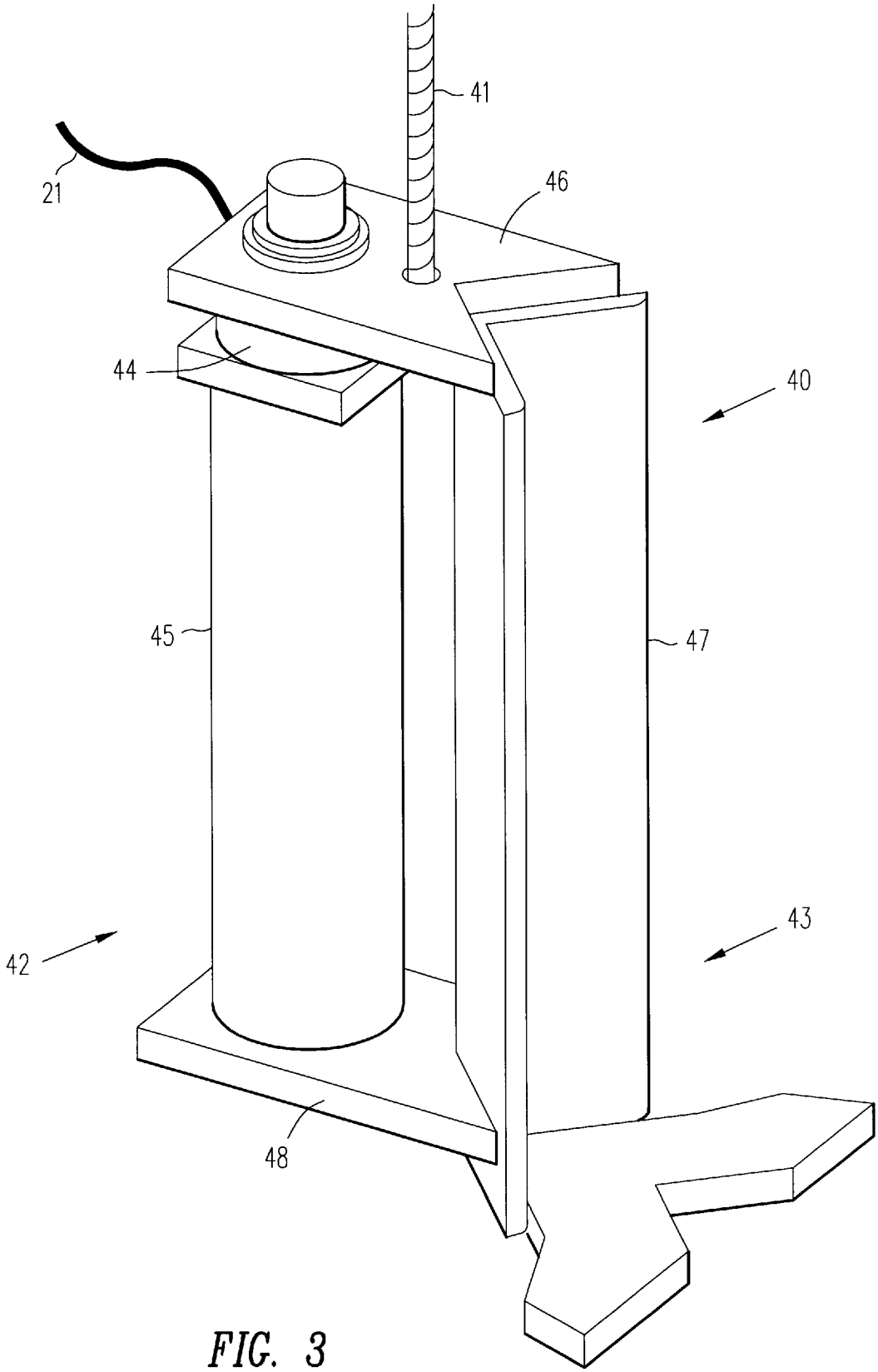
FIG. 3 illustrates a detailed view of a first embodiment of an end-effector.

The first embodiment is shown in FIG. 3. End-effector 40 is connected to a rope 41 and includes a human interface subsystem 42 and a load interface subsystem 43. Rope 41 could be, for example, either rope 13 (FIG. 1) or rope 29 (FIG. 2)

A force sensor 44 is installed between a handle 45 and a bracket 46 to measure the human force in the vertical direction on handle 45. Handle 45 is held by the operator. If handle 45 is pushed up or down, force sensor 44 measures the human force. Handle 45 is shown as a cylinder in FIG. 3, but it can be of any shape that is comfortable for the operator. For example, a horizontally oriented circular bar (similar to a steering wheel) can be connected to handle 45 at its center to enable the operator to grasp handle 45 from any direction.

A bracket 46 is connected to the rope 41. Although the right-hand side of bracket 46 can connect to various load interface devices such as suction cups or hooks, in the embodiment shown in FIG. 3 bracket 46 is welded to an angular bracket 47, which is used to hold an edge or a corner of a box. This makes the end-effector suitable for maneuvering in a system of the kind shown in FIG. 2, wherein a pair of end-effectors contact a load at two locations and are capable of rotating the load about its own axis. Angular bracket 47 touches a plate 48 which is connected to handle 45, but these two elements can freely slide vertically relative to each other because they are not connected. This free sliding motion between plate 48 and bracket 47 guarantees that the forces from the operator which are in the vertical direction pass through force sensor 44 without any resistance, while the forces from the operator which are not in the vertical direction are transferred to bracket 47 through plate 48. If these non-vertical forces were to pass through the force sensor, they could either produce a false reading in the sensor or damage the force sensor assembly.

In operation, the operator grips handle 45. If the operator pushes downward on handle 45, force sensor 44 generates a positive signal proportional to the downward force. If the operator pushes upward on handle 45, force sensor 44 generates a negative signal proportional to the human upward force.

A significant characteristic of end-effector 40 is that force sensor 44 measures only the human force imposed against the human interface subsystem 42, not the load force (the force imposed on the load interface subsystem by the load).

Figure 4:
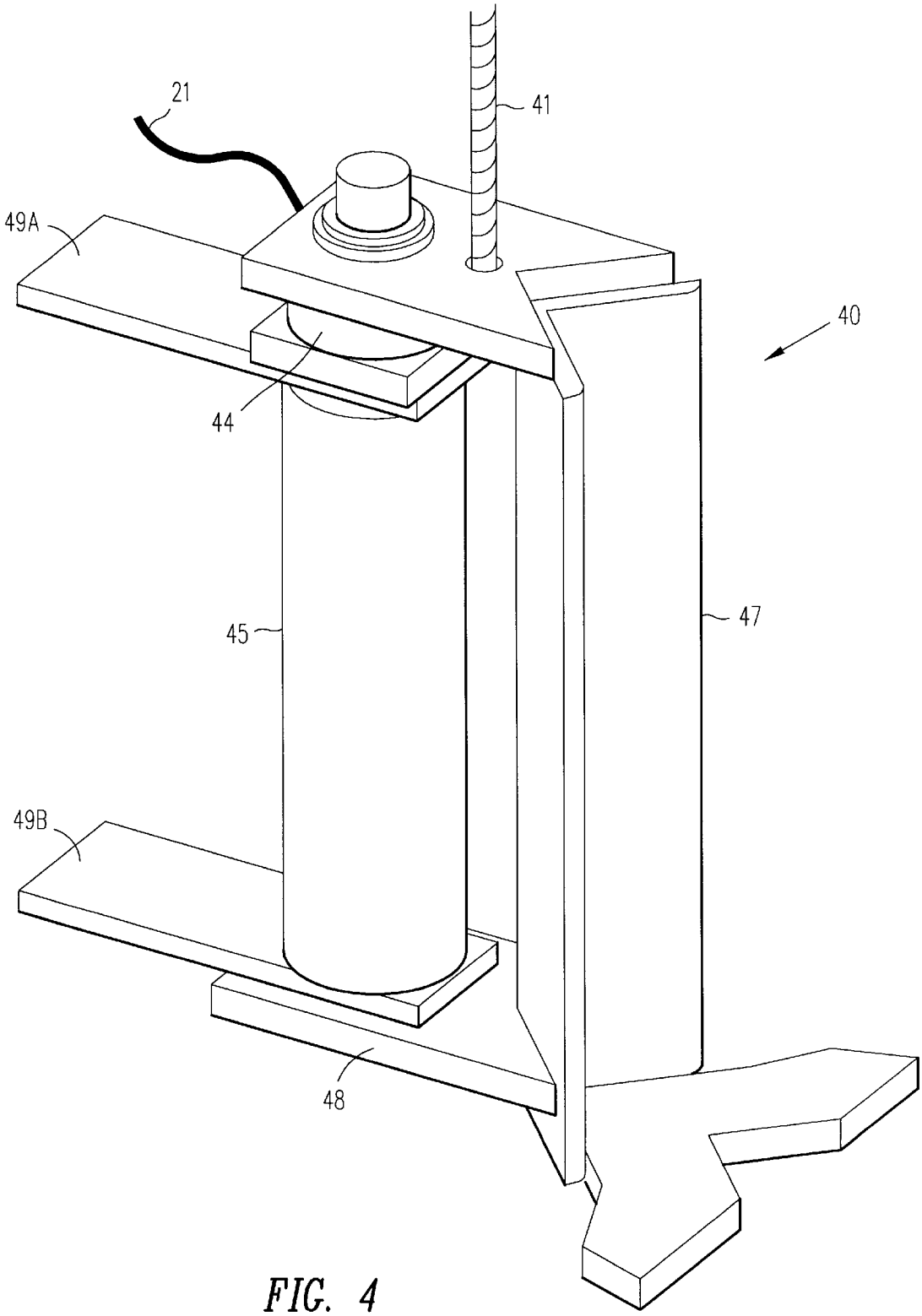
FIG. 4 illustrates a modified version of the end-effector shown in FIG. 3 including support plates for connecting the end-effector to a brace for the operator's hand and/or arm.
Figure 5:
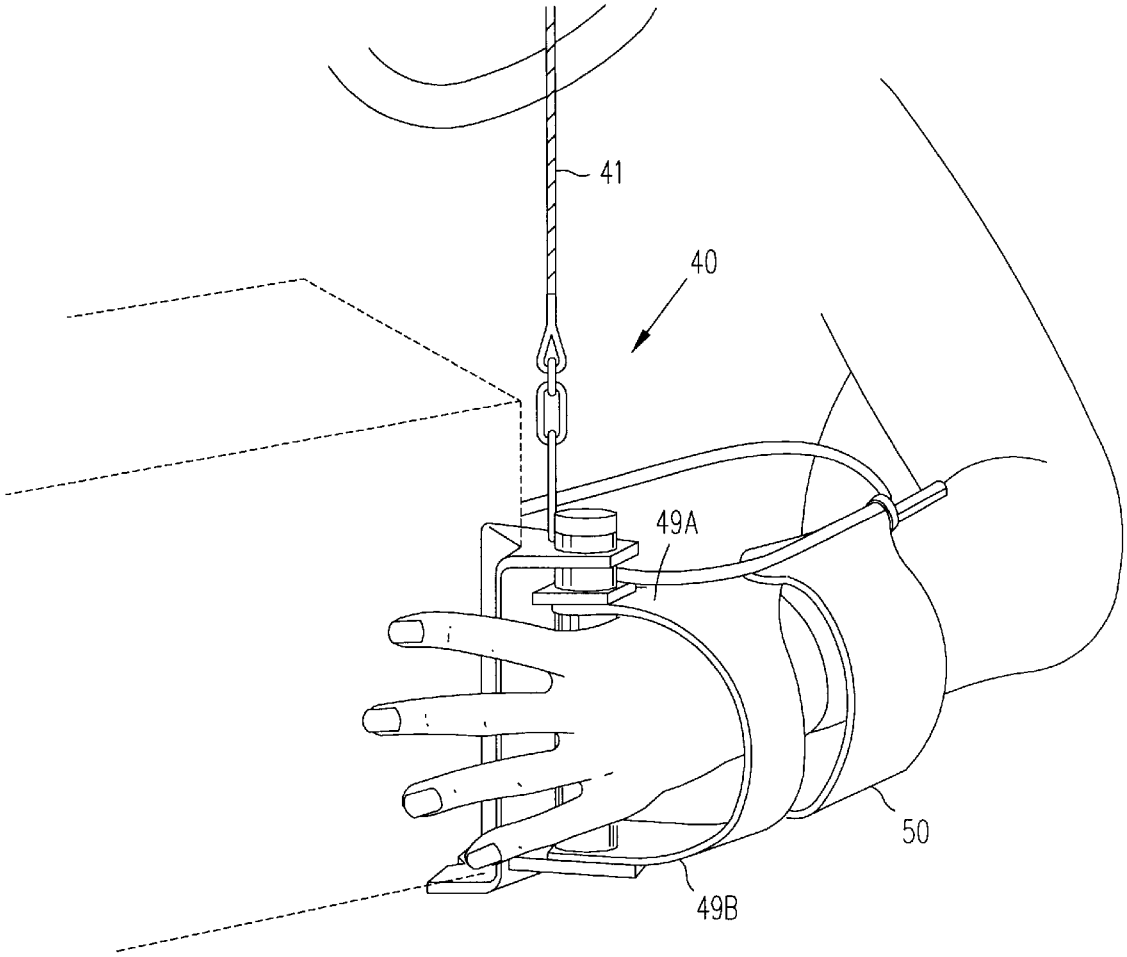
FIG. 5 illustrates an embodiment of a brace.

FIG. 4 shows a modified version of end-effector 40 with two support plates 49A and 49B that can connect to a brace for the operator's hand and arm. This is particularly useful when the human operator does not grasp the handle with his or her fingers. Suppose, for example, that handle 45 has a small radius and that the distance between handle 45 and angular bracket 47 is so small that the operator's fingers cannot wrap around the handle 45. Adding plates 49A and 49B allows the operator to exert force on handle 45 without holding it with his or her fingers. Moreover, a brace 50, as shown in FIG. 5, has been proven to create more stability and comfort for some operators.

When the operator initiates an upward motion, the human force which he or she exerts is recorded by the force sensor. The signal then generated by the force sensor is transmitted to the controller. The actuator and the take-up pulley turn appropriately, causing an upward motion of the rope and the end-effector assembly. This lifts the load and the end-effector together. Similarly, when the operator initiates a downward motion, the actuator and the take-up pulley turn appropriately, causing a downward motion of the rope and the end-effector assembly.

Force sensor 44 can be selected from a variety of force sensors that are available in the market, including piezoelectric based force sensors, metallic strain gage force sensors, semiconductor strain gage force sensors, and force sensing resistors. Regardless of the particular type of force sensor chosen and its installation procedure, the design should be such that the force sensor measures only the human force against end-effector 40.

Figure 6:
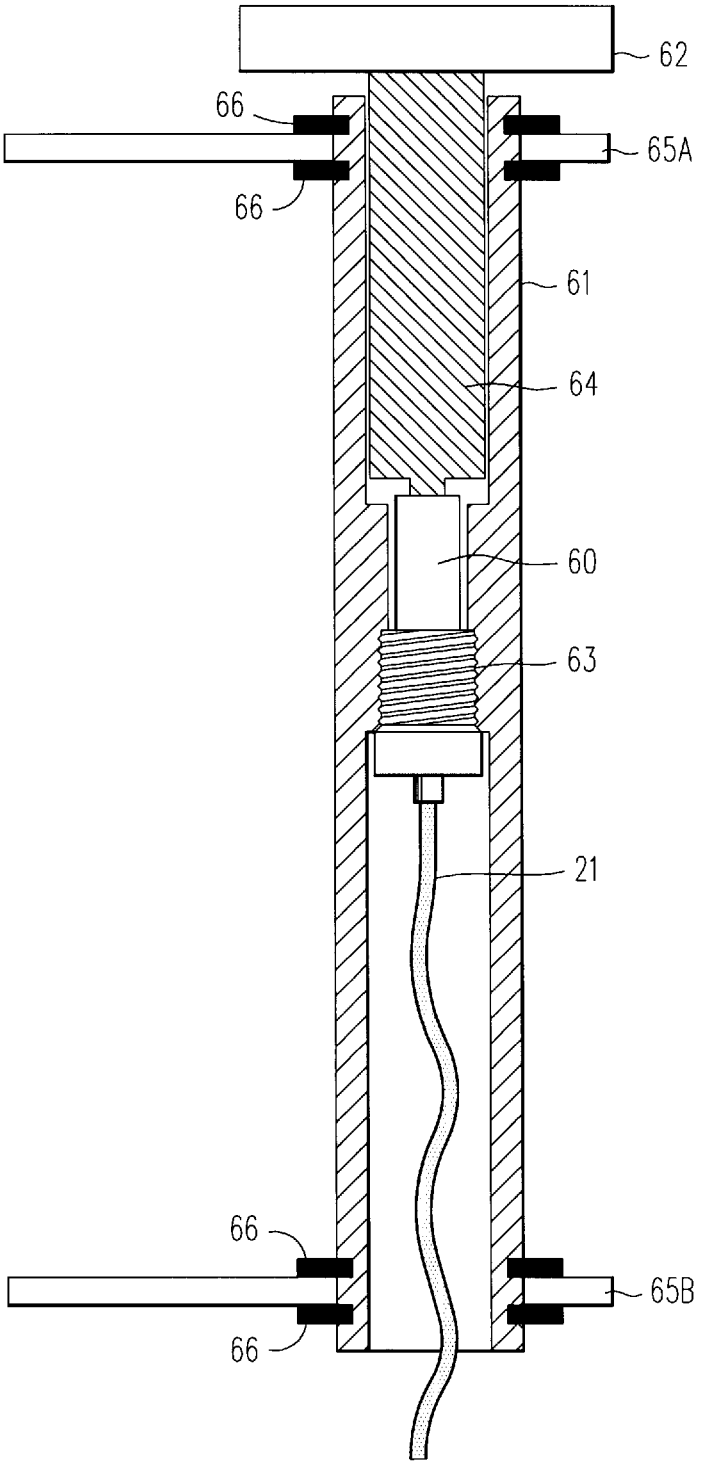
FIG. 6 illustrates a cross-sectional view of an embodiment of an end-effector, showing in particular the structure of the force sensor.

FIG. 6 shows a version of end-effector 40 which measures the vertical human force via a different type of force sensor installation. A force sensor 60, which may be similar to force sensor 44, is installed between a handle 61 and a bracket 62 and is connected to controller 20 via signal cable 21. Force sensor 60 has a threaded part 63 that screws into an inside bore within handle 61, which is grasped by the human operator. The other side of the force sensor 60 is connected to bracket 62 via a cylinder 64. The outside diameter of cylinder 64 is slightly smaller than the inside diameter of handle 61. This clearance allows a sliding motion between handle 61 and cylinder 64, which guarantees that the forces from the operator which are in the vertical direction pass through force sensor 60 without any resistance and that the forces from the operator which are not in the vertical direction are transferred to bracket 62 and not to force sensor 60. If these non-vertical forces pass through force sensor 60, they may either introduce false readings in the sensor or damage the force sensor assembly.

FIG. 6 also shows support plates 65A and 65B which can be connected to a brace for the operator's hand and/or arm. Four retaining rings 66 fit into slots in handle 61 to secure plates 65A and 65B and the brace to handle 61. Bracket 62 bolts to various load interface devices such as a hook or a suction cup (not shown).

Figure 7:
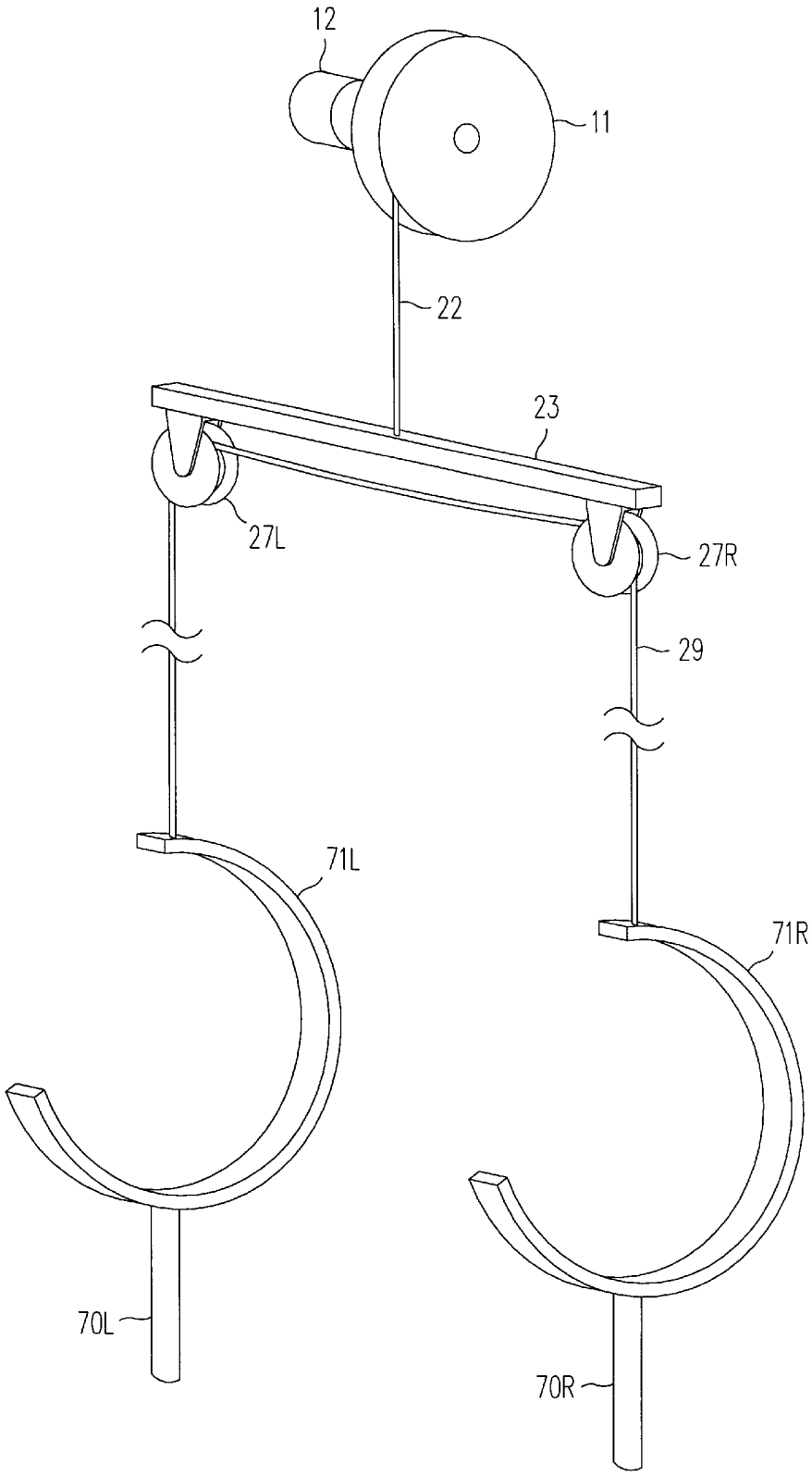
FIG. 7 illustrates a human power amplifier system with a pair of end-effectors which is designed to lift a human (e.g., a patient from a wheelchair).

FIG. 7 show a modified version of the system shown in FIG. 2, in which a pair of end-effectors 70L and 70R are connected to C-shaped members 71L and 71R for maneuvering patients from their wheelchairs to their beds and vice versa. C-shaped members 71L and 71R, which may be covered with a padded cushion, are to be placed under the patient's armpits. C-shaped members 71L and 71R are connected to bracket 62 of the end-effector.

In a second group of embodiments, the force imposed by the operator against the end-effector is measured by the displacement of the handle rather than a force sensor of the kind described above. The lower cost and ease of use of displacement measurement systems may make this type of end-effector more attractive in some situations.

Figure 8:
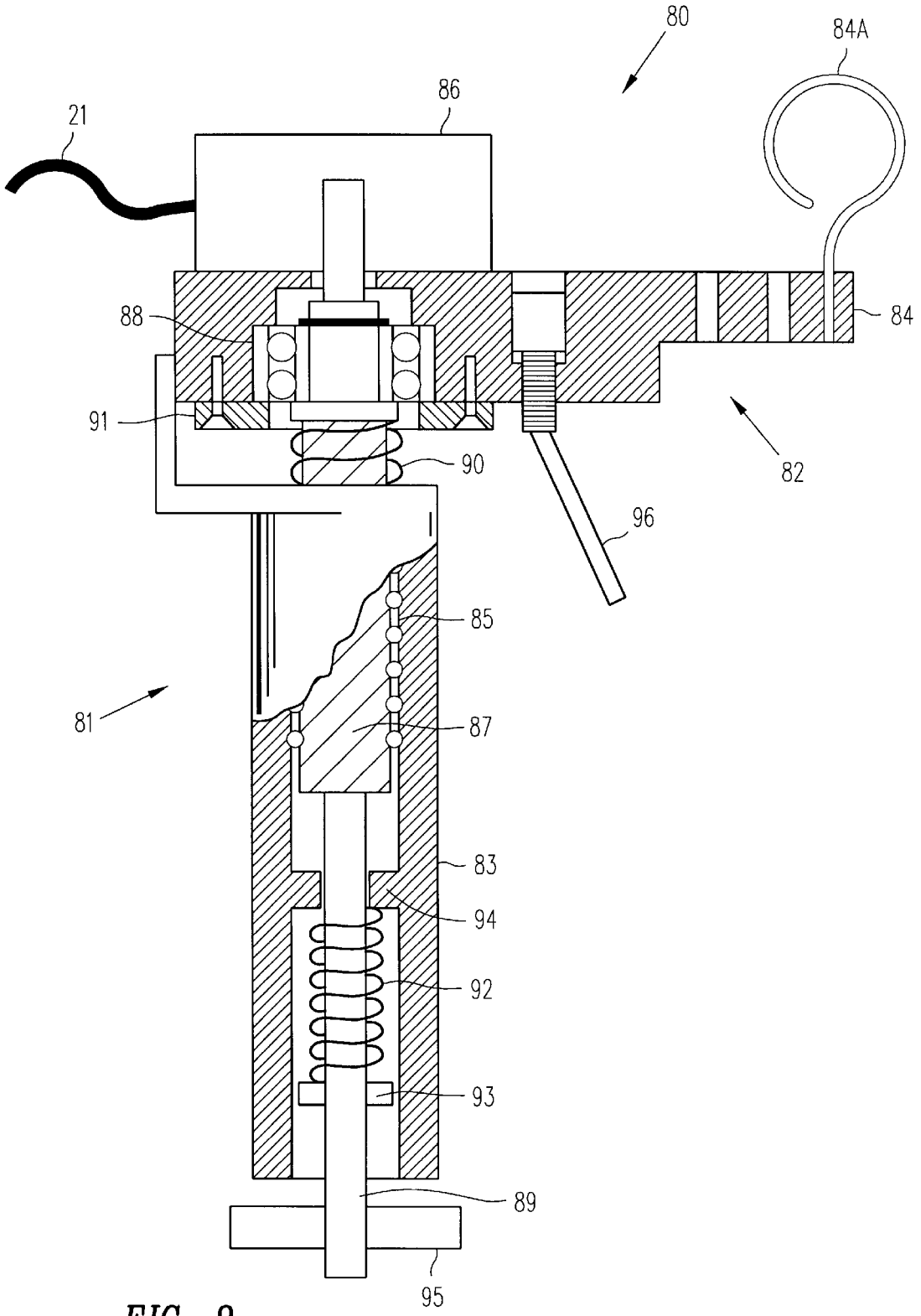
FIG. 8 illustrates a cross-sectional view of an embodiment of an end-effector which includes a displacement detector for measuring the force imposed on the end-effector by an operator.

A cross-sectional view of one embodiment of an end-effector of the second group is shown in FIG. 8. Similar to the end-effectors described above, end-effector 80 includes a human interface subsystem 81 and a load interface subsystem 82. Human interface subsystem 81 includes a handle 83 which is grasped by the operator and thus measures the human force, not the load force. Load interface subsystem 82 includes a bracket 84 that bolts to a hook or a suction cup or any other type of device that can be used to hold an object. An eyelet 84A is mounted in bracket 84 for connecting bracket 84 to a rope (not shown).

In end-effector 80 a ball-screw mechanism 85 translates the vertical displacement of handle 83 into a rotary displacement which is measured by an angle measuring device 86. Handle 83 functions as the ball-nut portion of ball-screw mechanism 85. The screw 87 of ball-screw mechanism 85 is secured by the inner race of a bearing system 88. Bearing system 88, here a double row bearing, includes of any combination of bearing(s) that allows rotation of screw 87 while supporting vertical and horizontal forces. A pair of angular contact bearings could also be used. Because of the connection between screw 87 and the inner race of bearing system 88, the inner race and screw 87 turn together. The outer race of the bearing system 88 is held in bracket 84 by a retaining ring 91 which is fixed to the bottom of bracket 84.

A shaft 89 extends from the lower end of screw 87 along the axis of handle 83. An upper coil spring 90 is positioned around screw 87 and between the upper end of handle 83 and retaining ring 91, and a lower coil spring 92 is positioned around shaft 89 between a stop 93 fixed to shaft 89 and a stop 94 formed in the interior of handle 83. Thus coil spring 90 urges handle 83 downward, and coil spring 92 urges handle 83 upward, and together springs 90 and 92 allow handle 83 to move axially with respect to screw 87 and shaft 89. A stop 95 mounted at the lower end of shaft 89 provides a limit to the downward movement of handle 83.

Handle 83, which functions as the ball-nut of the ball-screw mechanism 85, is held by the operator. If handle 83 is moved up and down without any rotation, then screw 87 turns. The amount of rotation of screw 87 depends on the lead of screw 87. For example, if the lead is ½", then for every ½" motion of handle 83, screw 87 turns one revolution.

Angle measuring device 86 connected to the top of bracket 84 measures the rotation of screw 87. Angle measuring device 86 can be an optical rotary encoder, a magnetic rotary encoder, a rotary potentiometer, a RVDT (Rotary Variable Differential Transformer), an analog resolver, a digital resolver, a capacitive rotation sensor or a Hall effect sensor. Angle measuring device 86 produces a signal proportional to the rotation of screw 87. Springs 90 and 92 return handle 83 to an equilibrium position when handle 83 is not pushed. As shown in FIG. 8, the spring pushes the ball-nut upward so the bracket stops the ball-nut.

To maintain a tension in the rope, an upward velocity is imposed on the rope when there is no load on the system (assuming that the end-effector itself is light). In this case, only one spring, a compression spring at the bottom of handle 83 or a tension spring at the top of handle 83, may be used to force handle 83 upward.

When using end-effector 80, the operator grasps handle 83. When the operator initiates an upward motion, handle 83 (the ball-nut) moves upward, causing screw 87 to turn (e.g., clockwise). This motion is recorded by angle measuring device 86. The generated signal from angle measuring device 86 is then transmitted to controller 20 (FIGS. 1 and 2). Actuator 12 turns pulley 11 appropriately, causing an upward motion of the rope and end-effector 80. This motion lifts the load and the end-effector 80 together. Similarly, when the operator initiates a downward motion, actuator 12 and the pulley 11 turn appropriately in the opposite direction, causing a downward motion of the rope and end-effector 80.

Thus, in end-effector 80 the vertical displacement of handle 83 relative to bracket 84 (which is proportional to the human force) is measured, and the measurement is fed to controller 20. Regardless of the type of displacement sensor used in this device and its installation procedure, this end-effector is designed to measure only the human force in the vertical direction. The end-effector does not measure the load force. A safety switch 96 is installed to transfer the actuator to another control mode (position control mode) or to turn the system off when the operator leaves the system.

Alternatively, ball-screw mechanism 85 in FIG. 8 can be replaced by a lead screw mechanism in which a sliding movement between a nut portion and a screw portion replaces the rolling motion of the balls. Preferably, there should be little friction between the nut portion and the screw portion, and the lead screw mechanism should be back drivable.

Figure 9:
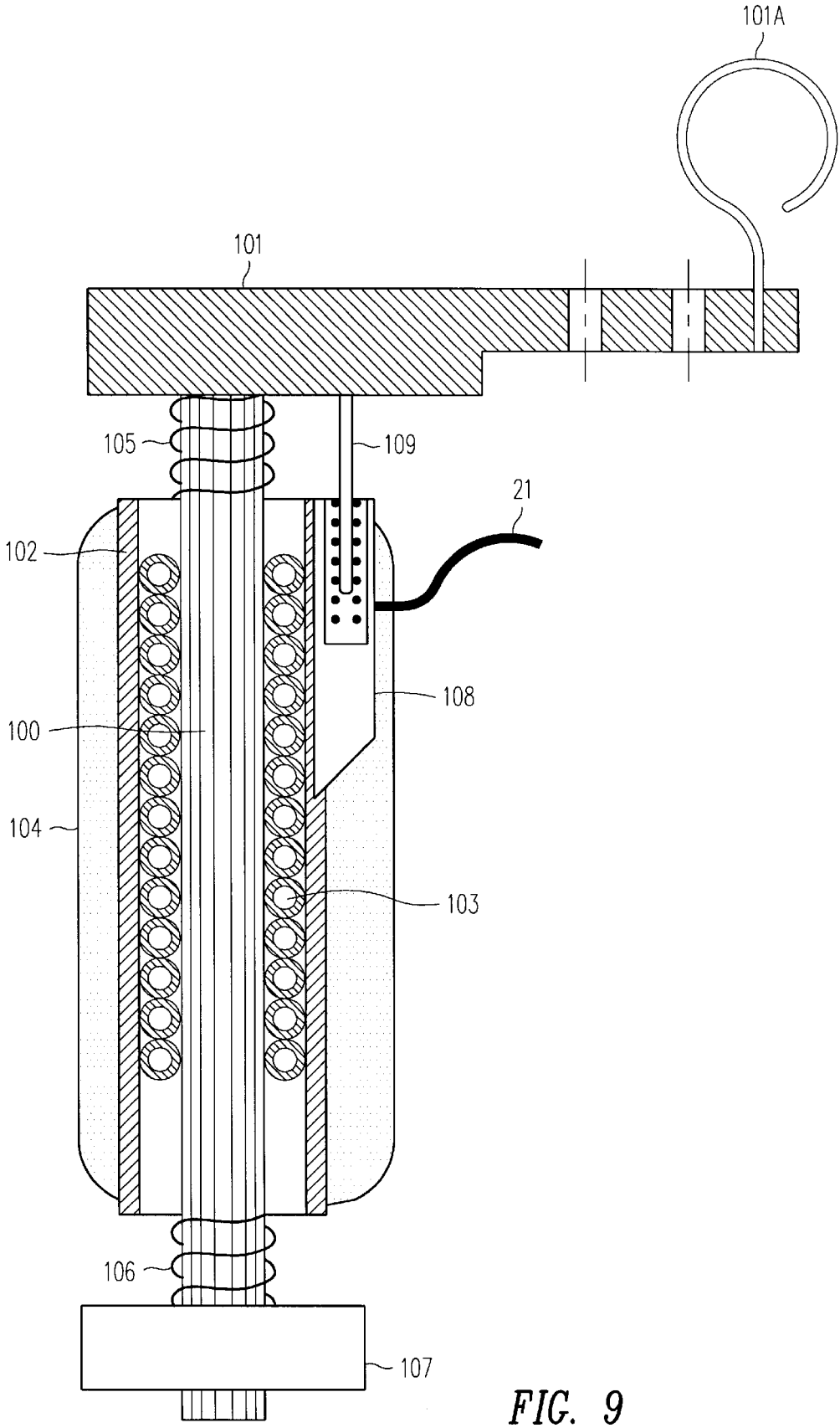
FIG. 9 illustrates a cross-sectional view of an alternative embodiment of an end-effector which includes a displacement detector for measuring the force imposed on the end-effector by an operator.

In this group of embodiments a variety of displacement sensors can be used to measure the spring deflection. FIG. 9 shows an end-effector in which the ball-screw mechanism is replaced with a ball spline shaft mechanism. A handle 102, which is in the ball-nut portion of the ball spline shaft mechanism, moves freely along a spline shaft 100, with no rotation relative to spline shaft 100. Balls 103 move in grooves on spline shaft 100. Handle 102 is held by the operator. A layer 104 of a foam like material can be included in handle 102, so that the operator can grab the handle more comfortably.

The right-hand side of bracket 101 is connected to a rope via an eyelet 101A and has hole patterns that allow for connection of a suction cup mechanism, a hook, or any device to hold the object. An upper coil spring 105 is positioned around spline shaft 100 between handle 102 and bracket 101 and urges handle 102 downward; similarly, a lower coil spring 106 is positioned around spline shaft 100 between handle 102 and a stop 107 and urges handle 102 upward. A linear motion detector 108 (e.g., a linear potentiometer or a linear encoder) contains a probe 109 which contacts bracket 101 so as to measure the motion of handle 102 relative to bracket 101. Linear motion detector 108 produces an electric signal on signal cable 21 which is proportional to the linear displacement of handle 102 relative to bracket 101.

Linear motion detector 108 can be an optical linear encoder, a magnetic linear encoder, a linear potentiometer, a LVDT (linear variable differential transformer), a capacitive displacement sensor, an eddy current proximity sensor or a variable-inductance proximity sensor. FIG. 9 shows a linear potentiometer having its housing connected to handle 102 and its probe 109 pushed against bracket 101. The motion of probe 109 relative to the potentiometer housing creates an electric signal proportional to the spring deflection.

Alternatively, the ball spline shaft mechanism shown in FIG. 9 can be replaced by a linear bushing mechanism, wherein a bushing (slider) and a shaft slide relative to one another with no balls. There should be little friction between the bushing (slider) and the shaft.

The sole purpose of the springs installed in the end-effector is to bring the handle back to an equilibrium position when no force is imposed on the handle by the operator. FIGS. 8 and 9 show the end-effector using compression springs. One can use other kinds of springs, such as cantilever beam springs, tension springs or belleville springs in the end-effector. Basically, any resiliant element capable of bringing the handle back to its equilibrium position will be sufficient. The structural damping in the springs or the friction in the moving elements of the end-effectors (e.g. bearings) provide sufficient damping in the system to provide stability.

Although not shown in the figures, one can install one or several switches on the end-effectors described herein to transfer the actuator to another control mode (position control mode) or to turn the system off when the operator leaves the system. A position controller freezes the actuator and consequently the end-effector at the position where it is when the operator leaves the system.

As described above, the force or displacement sensor in the end-effector delivers a signal to controller 20 which is used to control actuator 12 and to apply an appropriate torque to pulley 11. If e is the input command to actuator 12 then, in the absence of any other external torque on the actuator, the linear velocity of the outermost point of the pulley or the rope (v) can be represented by:

$$V=Ge \tag{1}$$

where G is the actuator transfer function. In addition to the input command (e) from the controller, the forces imposed on the end-effector also affect the rope velocity. There are two forces imposed on the end-effector which affect the rope velocity: a force ($f_R+f_L$) which is imposed by the operator's right hand and left hand, and a force (p) which is imposed by the load on the end-effectors (see FIG. 2). The input command (e) and the forces on the end-effectors contribute to the actuator speed such that:

$$v=Ge+S(f_R+f_L+p)-V_{UP} \tag{2}$$

where S is the actuator sensitivity function which relates the external forces to the rope velocity (V). S is defined as the downward velocity of the rope (or linear velocity of the outermost point on the pulley) generated if one unit of impulse tensile force is imposed on the rope. If a velocity controller is designed for the actuator so that S is small, the actuator has only a small response to the imposed tensile force on the rope. A high-gain controller in the closed-loop velocity system results in a small S and consequently a small change in actuator velocity in response to forces imposed on the rope. Also note that a high ratio transmission system on the actuator produces a small S for the system. Note that ($f_R+f_L+p$) is the total tensile force in rope 13 assuming bar 23 has negligible mass in comparison with the other forces. To develop tension in ropes 13, 22 and 29 (FIGS. 1 and 2) at all times, an upward biased rope velocity ($V_{UP}$) is introduced to the system.

A reasonable performance specification for the actuator is the level of amplification of the human force ($f_R+f_L$) that is applied to the end-effector. If the force amplification is large, a small force applied by the operator results in a large force being applied to the load via the rope. If the force amplification is small, a small force applied by the operator results in a small force being applied to the load via the rope. Consequently, if the force amplification is large, the operator "feels" only a small percentage of the force required to lift the load. Importantly, the operator still retains a sensation of the dynamic characteristics of the free mass, yet the load essentially "feels" lighter. With this heuristic idea of system performance, the system performance can be defined as a number that is referred to as the force amplification factor. For example, when the force amplification factor of the system is programmed to be 5, the force on the end-effector from the load is 5 times the force that the operator is applying to the end-effector. The following explains how to guarantee this for the amplifier. The human forces $f_R$ and $f_L$ are measured and passed through controller 20, which delivers a signal (e) to actuator 12. If the transfer function of the controller is represented by K, then the output of the controller, e, is equal to $K(f_R+f_L)$.

Substituting for e in equation (2) results in the following equation for the rope velocity (v):

$$v=GK(f_R+f_L)+S(f_R+f_L+p)-V_{UP} \tag{3}$$

Now suppose that the operator maneuvers two different objects through similar trajectories. Since the object weights are different from each other in these two experiments, then the resulting force that the operator experiences during each maneuver will be different. Any change in the force from the load on the end-effector due to variation of the object mass ($\Delta p$) will result in a variation of the human force according to the following equation if no change in maneuvering speed is expected:

$$(GK/S+1)(\Delta f_R+\Delta f_L)=-\Delta p \tag{4}$$

where $\Delta f_L$ and $\Delta f_R$ are the change in the human force on the end-effector.

Figure 10:
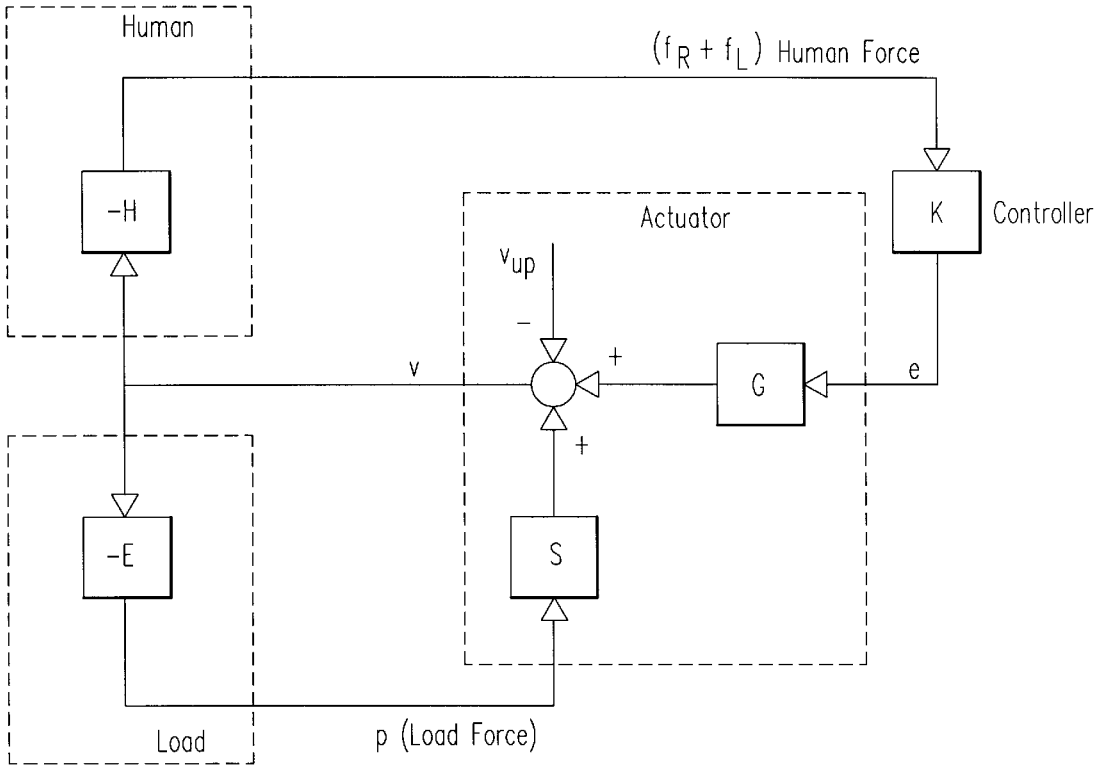
FIG. 10 illustrates a schematic diagram of the manner in which the operator and load forces interact with the elements of the human power amplifier to provide a movement to a load.

The term (GK/S+1) in equation (4) is the force amplification factor. This term relates the change in the load force ($\Delta p$) to the change in the human force ($\Delta f_R+\Delta f_L$). The larger K is chosen to be, the greater the force amplification in the system. K must be designed to yield an appropriate force amplification. FIG. 10 shows diagrammatically how the human force and load force are generated. As FIG. 10 indicates, K may not be arbitrarily large. Rather, the choice of K must guarantee the closed-loop stability of the system shown in FIG. 10. The human force ($f_R+f_L$) is a function of human arm impedance (H), whereas the load force (p) is a function of load dynamics (E), i.e. the gravitational and inertial forces generated by the load.

As described above, the device in FIG. 2 allows the operator not only to lift, but also to rotate the object. The torque required to rotate the object is delivered entirely by the human without any assistance from the device. Therefore, although the device shown in FIG. 2 allows for small rotational maneuvers of the object, highly accelerated rotations of the object are not recommended. Similarly, lifting objects with an uneven weight distribution requires torque which must be supported by the human entirely and is not recommended. In summary, the operator must make sure that the weight of the object being lifted is in the middle of the end-effectors. Moreover, if needed, the objects must be rotated with very little acceleration. It can easily be understood that under the above assumption, the human forces on both end-effectors are equal to each other: i.e. $f_R=f_L$ and equation (4) reduces to $$(2GK/S+2)\Delta f_R=-\Delta p \quad (5)$$

The above equation is also true for the left end-effector.

As described above, in operating with two end-effectors one can install a force sensor on one of the end-effectors only. If only the right end-effector has a force sensor, then the analysis (similar to the analysis above) reduces to:

$$(GK/S+2)\Delta f_R=-\Delta p \quad (6)$$

This indicates, for a given K, the force amplification when only one end-effector is instrumented is smaller than the force amplification when both end-effectors are instrumented.

Note that if the system operates as shown in FIG. 1 (i.e. one end-effector only), then equation (4) reduces to:

$$(GK/S+1)\Delta f_R=-\Delta p \quad (7)$$

Thus the end-effector electronically senses the force from the human hand gripping the end-effector. The measurement of the hand force is transmitted to the device's controller. Using this measurement, the controller calculates the amount of pulley rotation necessary to either raise or lower the pulley rope the correct distance to create enough mechanical strength to assist the operator in the lifting task. In this way, the end-effector follows the human arm motions in a "natural" way. In other words the pulley, the rope, and the end-effector mimic the lifting/lowering movements of the human operator, and the human is able to manipulate heavy objects more easily without the use of any intermediary device.

The rope supports only a pre-programmed proportion of the load forces (i.e., gravity plus inertial force due to acceleration), not the entire load force; the remaining force is supported by the operator. This method of load sharing gives the operator a sense of how much he/she is lifting. This is true because the force the human is imposing on the end-effector is exactly equal to a scaled-down value of the actual force the load is imposing on the rope. The measured signal from the end-effector, a signal representing the human force, is used via a computer or electronic circuitry to drive the actuator appropriately so that only a pre-programmed small proportion of the load force is lifted by the operator. Therefore the actuator adds effort to the lifting task only in response to the operator's hand force. For example, if the human force is set to be 10% of the actual force needed to lift the load, for every 50 lbs. of force (gravity plus inertia force due to acceleration) the pulley rope could support 45 lbs. while the operator feels and supports 5 lbs. The allocation of the load forces between the pulley rope and the human is programmable.

Although particular embodiments of the invention are illustrated in the accompanying drawings and described in the foregoing detailed description, it is understood that the invention is not limited to the embodiments disclosed, but is intended to embrace any alternatives, equivalents, modifications and/or arrangements of elements falling within the scope of the invention as defined by the following claims. The following claims are intended to cover all such modifications and alternatives.

I claim:

1. An end-effector for use in a human power amplifier system, said end-effector comprising:

a load interface subsystem for making contact between said end-effector and a load;

a human interface subsystem comprising a handle and a force sensor, said force sensor being for measuring a force imposed on said handle by a human operator and being capable of generating an electrical signal representative of a magnitude of said force.

2. The end-effector of claim 1 wherein said force sensor is interposed between said handle and said load interface subsystem.

3. The end-effector of claim 1 wherein said force sensor comprises a piezoelectric element.

4. The end-effector of claim 1 wherein said force sensor comprises a strain gauge.

5. The end-effector of claim 4 wherein said strain gauge is a metallic strain gauge.

6. The end-effector of claim 4 wherein said strain gauge is a semiconductor strain gauge.

7. The end-effector of claim 1 wherein said force sensor comprises a resilient member and a device for measuring a displacement of said resilient member.

8. The end-effector of claim 7 wherein said resilient member comprises a spring.

9. The end-effector of claim 1 wherein said end-effector further comprises a ball-screw arrangement for transforming a linear motion of said handle into a rotary motion, said ball-screw arrangement comprising a nut portion and a screw portion.

10. The end-effector of claim 1 wherein said end-effector further comprises a lead screw arrangement for transforming a linear motion of said handle into a rotary motion, said lead screw arrangement comprising a nut portion and a screw portion.

11. The end-effector of claim 9 or 10 wherein said handle is a part of said nut portion and is constrained to move linearly along a longitudinal axis of said screw portion.

12. The end-effector of claim 9 or 10 further comprising an angle measuring device for measuring a rotation of said screw portion relative to said nut portion.

13. The end-effector of claim 12 wherein said angle measuring device comprises a rotary optical encoder.

14. The end-effector of claim 12 wherein said angle measuring device comprises a rotary potentiometer.

15. The end-effector of claim 12 wherein said angle measuring device comprises a rotary magnetic encoder.

16. The end-effector of claim 12 wherein said angle measuring device comprises a rotary variable differential transformer.

17. The end-effector of claim 12 wherein said angle measuring device comprises an analog resolver.

18. The end-effector of claim 12 wherein said angle measuring device comprises a digital resolver.

19. The end-effector of claim 12 wherein said angle measuring device comprises a capacitive rotation sensor.

20. The end-effector of claim 12 wherein said angle measuring device comprises a Hall effect sensor.

21. The end-effector of claim 1 wherein said human interface subsystem comprises a linear ball spline shaft mechanism wherein said handle is a part of a ball-nut portion of said linear ball spline shaft mechanism and a shaft portion of said linear ball spline shaft mechanism is fixed to said load interface subsystem.

22. The end-effector of claim 21 further comprising a linear potentiometer for measuring a linear displacement of said ball-nut portion relative to said shaft portion.

23. The end-effector of claim 21 further comprising a linear optical encoder for measuring a linear displacement of said ball-nut portion relative to said shaft portion.

24. The end-effector of claim 21 further comprising a linear magnetic encoder for measuring a linear displacement of said ball-nut portion relative to said shaft portion.

25. The end-effector of claim 21 further comprising a linear variable differential transformer for measuring a linear displacement of said ball-nut portion relative to said shaft portion.

26. The end-effector of claim 21 further comprising a capacitive displacement sensor for measuring a linear displacement of said ball-nut portion relative to said shaft portion.

27. The end-effector of claim 21 further comprising an eddy current proximity sensor for measuring a linear displacement of said ball-nut portion relative to said shaft portion.

28. The end-effector of claim 21 further comprising a variable inductance proximity sensor for measuring a linear displacement of said ball-nut portion relative to said shaft portion.

29. The end-effector of claim 1 wherein said human interface subsystem comprises a linear bushing mechanism wherein said handle is a part of a bushing portion of said linear bushing mechanism and a shaft portion of said linear bushing mechanism is fixed to said load interface subsystem.

30. The end-effector of claim 29 further comprising a linear potentiometer for measuring a linear displacement of said bushing portion relative to said shaft portion.

31. The end-effector of claim 29 further comprising a linear optical encoder for measuring a linear displacement of said bushing portion relative to said shaft portion.

32. The end-effector of claim 29 further comprising a linear magnetic encoder for measuring a linear displacement of said bushing portion relative to said shaft portion.

33. The end-effector of claim 29 further comprising a linear variable differential transformer for measuring a linear displacement of said bushing portion relative to said shaft portion.

34. The end-effector of claim 29 further comprising a capacitive displacement sensor for measuring a linear displacement of said bushing portion relative to said shaft portion.

35. The end-effector of claim 29 further comprising an eddy current proximity sensor for measuring a linear displacement of said bushing portion relative to said shaft portion.

36. The end-effector of claim 29 further comprising a variable inductance proximity sensor for measuring a linear displacement of said bushing portion relative to said shaft portion.

37. The end-effector of claim 1 wherein said load interface subsystem comprises at least one suction cup.

38. The end-effector of claim 1 wherein said load interface subsystem comprises an angle piece for interacting with an edge of a box-shaped load.

39. The end-effector of claim 1 wherein said load interface subsystem comprises a C-shaped member for placement under a human armpit.

40. The end-effector of claim 1 further comprising a means for attaching a line to said end-effector.

41. The end-effector of claim 1 further comprising a brace attached to said handle.

42. A human power amplifier system comprising:

an end-effector comprising a human interface subsystem for interfacing with an operator and a load interface subsystem for interfacing with a load, said human interface subsystem comprising a force sensor for measuring a human force imposed on said end-effector;

an actuator for providing power to lift said end-effector; and a controller, said controller being coupled to said force sensor so as to receive an output signal generated by said force sensor and being coupled to said actuator so as to provide an input signal to said actuator, a magnitude of said output signal from said force sensor varying gradually as a function of said magnitude of said human force.

43. The human power amplifier system of claim 42 wherein said actuator comprises an electric motor.

44. The human power amplifier system of claim 42 wherein said actuator is air-powered.

45. The human power amplifier system of claim 42 wherein said actuator is hydraulic.

46. The human power amplifier system of claim 42 further comprising a line coupled to said end-effector for enabling said actuator to lift said end-effector.

47. The human power amplifier system of claim 42 wherein a speed of said actuator is determined by said magnitude of said human force imposed on said end-effector, as measured by said force sensor.

48. The human power amplifier system of claim 42 further comprising a second end-effector coupled to said end-effector via a line, said line running over at least one pulley, said second end-effector comprising a human interface subsystem for interfacing with said operator and a load interface subsystem for interfacing with a load.

49. The human power amplifier system of claim 48 wherein said second end-effector further comprises a force sensor for measuring a human force imposed on said second end-effector, said controller being coupled to said second force sensor so as to receive a second output signal from said second force sensor.

50. The human power amplifier system of claim 42 wherein said output signal is an electrical signal.

51. A method of lifting a load comprising the steps of:

providing an actuator for providing an actuator force for lifting said load;

providing an end-effector for providing an interface between a human operator and said load;

causing said end-effector to engage said load;

detecting a magnitude of a human force imposed by said operator on said end-effector as said operator lifts said end-effector, said magnitude of said human force varying gradually as said operator lifts said end-effector;

using said magnitude of said human force to regulate said actuator; and causing said actuator to lift said load.

52. The method of claim 51 wherein said magnitude of said human force is used to determine a velocity of said actuator.

53. The method of claim 51 comprising the further step of causing said actuator to lift said load when said magnitude of said human force is equal to zero.

54. The method of claim 51 wherein the step of detecting a magnitude of a human force imposed by said operator on said end-effector comprises generating an electrical signal representative of said magnitude of said human force.

55. The method of claim 51 wherein the step of regulating said actuator comprises programming a controller such that a ratio of a change in the human force to a change in the actuator force remains substantially constant.

56. The method of claim 55 comprising the step of programming said controller such that said ratio is equal to GK/S+1, where G is a transfer function of said actuator, K is transfer function of said controller and S is a sensitivity function of said actuator.

* * * * *

UNITED STATES PATENT AND TRADEMARK OFFICE

CERTIFICATE OF CORRECTION

PATENT NO. : 5,865,426
DATED : February 2, 1999
INVENTOR(S) : Kazerooni

It is certified that error appears in the above-identified patent and that said Letters Patent is hereby corrected as shown below:

Title page,
Before "FIELD OF THE INVENTION" please insert the following:

-- GOVERNMENT SUPPORT

This work was supported in part by a grant from the National Science Foundation, Grant No. MSS-9196179. The government may have certain rights in this invention. --

Signed and Sealed this

Twenty-fifth Day of December, 2001

*Attest:*

*Attesting Officer*

JAMES E. ROGAN
*Director of the United States Patent and Trademark Office*